US011686270B2

(12) United States Patent
Schmoll et al.

(10) Patent No.: US 11,686,270 B2
(45) Date of Patent: Jun. 27, 2023

(54) CAST PISTON FOR AN INTERNAL COMBUSTION ENGINE, CONSISTING OF AN IRON-BASED MATERIAL

(71) Applicant: FEDERAL-MOGUL NURNBERG GMBH, Nuremberg (DE)

(72) Inventors: Christoffer Schmoll, Nuremberg (DE); Rainer Weiss, Nuremberg (DE); Michael Seiffert, Nuremberg (DE); Mark Day, Spardorf (DE); Georg Hopp, Rednitzhembach (DE); Florian Sigel, Erlangen (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 0 days.

(21) Appl. No.: 15/734,001

(22) PCT Filed: Jun. 6, 2019

(86) PCT No.: PCT/EP2019/064820
§ 371 (c)(1),
(2) Date: Dec. 1, 2020

(87) PCT Pub. No.: WO2019/238528
PCT Pub. Date: Dec. 19, 2019

(65) Prior Publication Data

US 2021/0215118 A1 Jul. 15, 2021

(30) Foreign Application Priority Data

Jun. 13, 2018 (DE) ..... 10 2018 209 455.1

(51) Int. Cl.
*F02F 3/00* (2006.01)
*F02F 3/02* (2006.01)

(52) U.S. Cl.
CPC ..... *F02F 3/0084* (2013.01); *F02F 3/027* (2013.01); *F02F 2003/0007* (2013.01); *F05C 2201/0442* (2013.01); *F05C 2201/0448* (2013.01)

(58) Field of Classification Search
CPC ..... F02F 3/027; F16J 1/001; F05C 2201/0448
(Continued)

(56) References Cited

U.S. PATENT DOCUMENTS 1,675,174 A * 6/1928 Hartog ..... F02F 3/0076 92/236
4,195,600 A * 4/1980 Shingai ..... F02F 3/24 123/43 AA (Continued)

FOREIGN PATENT DOCUMENTS

CN 101040136 A 9/2007
DE 3024891 A1 2/1982

(Continued)

OTHER PUBLICATIONS

International Search Report, dated Sep. 11, 2019 (PCT/EP2019/064820).

(Continued)

*Primary Examiner* — Long T Tran
*Assistant Examiner* — James J Kim
(74) *Attorney, Agent, or Firm* — Robert L. Stearns; Dickinson Wright, PLLC

(57) ABSTRACT

A cast piston for an internal combustion engine is made of an iron-based material and has windows in at least one side wall carrying a piston pin boss. The windows are asymmetric relative to one another on the side of the skirt walls.

11 Claims, 1 Drawing Sheet

(58) Field of Classification Search
USPC ..... 123/193.6
See application file for complete search history.

(56) References Cited

U.S. PATENT DOCUMENTS

| | | | | |
|---|---|---|---|---|
| 4,691,622 | A * | 9/1987 | Sander | F16J 1/02 92/233 |
| 4,809,652 | A * | 3/1989 | Essig | F02F 3/022 123/193.6 |
| 5,058,489 | A * | 10/1991 | Iwaya | F16J 1/04 92/233 |
| 5,331,932 | A | 7/1994 | Watanabe et al. | |
| 5,713,262 | A | 2/1998 | Sugiyama et al. | |
| 5,839,407 | A * | 11/1998 | Suzuki | F02F 3/0076 123/193.6 |
| 6,973,723 | B2 * | 12/2005 | Cagney | F02F 3/26 29/888.047 |
| 7,406,941 | B2 * | 8/2008 | Zhu | F16J 1/09 123/193.6 |
| 9,004,037 | B2 * | 4/2015 | Muscas | F16J 1/008 92/219 |
| 2006/0037471 | A1 * | 2/2006 | Zhu | F16J 1/001 123/193.6 |
| 2010/0139480 | A1 | 6/2010 | Ohmori et al. | |
| 2010/0147252 | A1 | 6/2010 | Langner et al. | |
| 2011/0030645 | A1 * | 2/2011 | Rebello | F02F 3/22 123/193.6 |
| 2016/0160325 | A1 * | 6/2016 | Mito | C22C 33/08 420/15 |
| 2016/0177866 | A1 * | 6/2016 | Fröde | F16J 1/16 123/193.6 |
| 2016/0258382 | A1 | 9/2016 | Perrone et al. | |
| 2018/0335140 | A1 | 11/2018 | Ichikawa et al. | |

FOREIGN PATENT DOCUMENTS

| | | | |
|---|---|---|---|
| DE | 4122921 | C2 | 4/1999 |
| DE | 69611577 | T2 | 8/2001 |
| DE | 10213215538 | B4 | 2/2015 |
| EP | 0043147 | A1 | 1/1982 |
| EP | 0050257 | A1 | 4/1982 |
| WO | 2006014741 | A2 | 2/2006 |
| WO | 2009006650 | A1 | 1/2009 |
| WO | 2016139100 | A1 | 9/2016 |
| WO | 2017086103 | A1 | 5/2017 |

OTHER PUBLICATIONS

Moebus H. "Gegenwärtige Und Künfitige Gestaltung Von Kolben Für Grosse Viertakt-Dieselmotoren" MTZ—Motortechnische Zeitschrift, Springer, vol. 50, No. 5, May 1, 1989 (May 1, 1989), pp. 237-240 ISSN: 0024-8525, XP000083245, Chapter 2.1 GGG piston; p. 238.

* cited by examiner

CAST PISTON FOR AN INTERNAL COMBUSTION ENGINE, CONSISTING OF AN IRON-BASED MATERIAL

TECHNICAL FIELD

The invention relates to a cast piston for an internal combustion engine, made of an iron-based material.

Pistons for internal combustion engines are generally required to be designed so as to be as low-weight as possible and at the same time to be able to withstand loads during operation.

PRIOR ART

Pistons made of steel, in particular, are usually forged in a one-piece or two-piece design. Light metal pistons made of aluminum alloys are usually cast.

A cast steel piston having recesses in the region of side walls which carry the piston pin boss is known from U.S. Pat. No. 7,406,941 B2. A similar piston can be found in DE 10 2013 215538 B4.

DESCRIPTION OF THE INVENTION

Given this background, the object of the invention is to improve a piston for an internal combustion engine, in particular in terms of the production costs thereof, and/or the friction and/or noise emissions.

The solution to this object is achieved by the piston described in claim 1.

According thereto, the piston is cast from an iron-based material and has windows in at least one side wall carrying a piston pin boss; in other words, it has openings or through-holes which are asymmetric relative to one another at least on the side of the skirt walls. The skirt walls are the sections of cylinder jacket surfaces with which the piston is in sliding contact during operation with a cylinder bore or a cylinder sleeve inserted therein. With regard to the piston pin boss, it should be noted that this is preferably closed; in other words, with the exception of a removal groove it has no discontinuities. Moreover, it is stressed that the piston according to the invention is preferably cast in one piece, preferably has a cooling channel and is preferably used as a diesel piston.

The aforementioned asymmetric design of the windows firstly allows additional weight to be saved as compared with pistons known to date, depending on the loads on the pressure side and counter-pressure side. At the same time, appropriate tests can ensure that requirements in terms of loads during operation are met. In this context, casting is particularly advantageously used as the production method, since it allows a higher degree of freedom when shaping and forming complex geometries, such that overall a piston shape that is optimized for stress can be produced inexpensively, and costly and complex machining can be reduced.

A further advantageous effect of the windows described is that the resilience of the skirt is increased in the region above the pin axis. Due to the resulting greater deformation of the skirt with alternating contact, the impulse transmitted to the cylinder bore is reduced, such that noise emissions are also reduced. Moreover, the necessary strength can be ensured by way of FE analyses, for example. The use of an iron-based material, which has a higher strength than aluminum materials conventionally used in casting, is also advantageous in this context.

Preferred developments of the piston according to the invention are described in the rest of the claims.

There are particular advantages if a window on at least one side of the piston and at least one side of the piston pin bore, preferably the counter-pressure side, extends into the skirt wall. In other words, the cylindrical skirt wall surface is cut in this region, such that the bearing region of the piston, in other words the contact surface between the piston skirt and the cylinder wall, is reduced. This reduces the friction, and as a consequence in an advantageous manner also the fuel consumption and the emissions. It should be noted that in spite of the preferred embodiment of the measure described on the counter-pressure side, there may be situations relating to the use of the piston and the resulting strain in which it is preferable for the described arrangement to be on the pressure side or on both sides.

For a harmonious design of the respective window it is preferred that the skirt wall is cut concavely, so that a concave structure remains on the skirt wall.

The described advantages can be utilized particularly extensively if the width of the skirt wall in the circumferential direction is reduced by at least 40%, as compared with the widest point, due to the window(s) at its narrowest point.

With regard to the arrangement of the windows it has proven advantageous for at least one of the windows present, preferably all of the windows, to be formed along the piston stroke axis primarily in the half of the side wall that is closer to the piston crown, which delimits the combustion chamber.

A design in which the window extends only slightly into the lower half is particularly preferred. For instance, the window may have at its "highest" point an extension of over 40%, preferably at least 60%, of the skirt or side wall height and/or it may begin right at the upper end thereof.

With regard to the material of the piston according to the invention, cast iron with spheroidal graphite, in other words spheroidal graphite cast iron, is firstly currently preferred. This material advantageously has a low specific weight, which, in particular, is lower than that of forged steels.

In certain situations, however, cast steel may be preferred as the material, which has a higher density but also a higher strength. This can additionally reduce wall thicknesses, and it may reduce the overall weight. Regardless of the material, sand casting is currently preferred as the casting method, though chill casting is also conceivable.

Furthermore, it is preferable for the material of the piston according to the invention to have a lower thermal conductivity than steel, such that the heating process of the internal combustion engine in the warm-up phase can be accelerated. This allows the engine to reach the operating temperature faster, and therefore also the efficient operating range, such that fuel consumption and polluting emissions can be further reduced.

BRIEF DESCRIPTION OF THE DRAWINGS

In the following, the invention will be described in more detail on the basis of an embodiment example as shown in the drawings. In the drawings.

DETAILED DESCRIPTION OF A PREFERRED EMBODIMENT OF THE INVENTION

Figure 1:
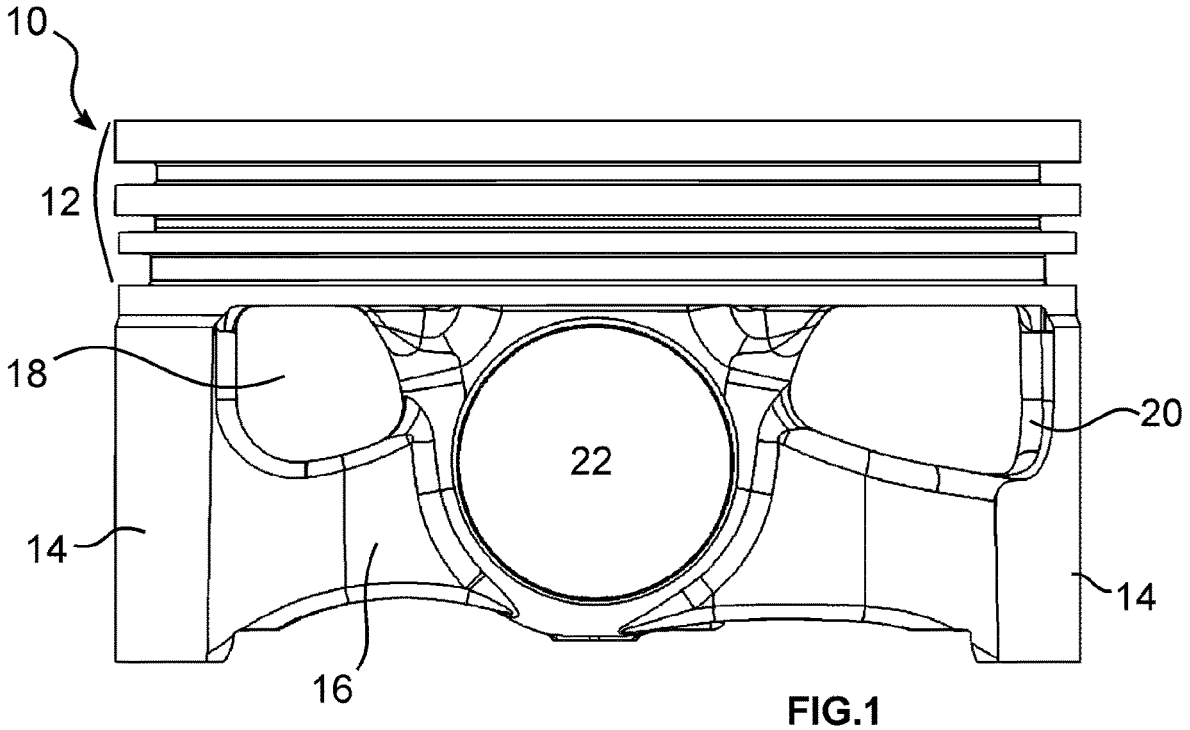
FIG. 1 is a side view of the piston according to the invention in the direction of the piston pin axis.

As can be seen in FIG. 1, the piston 10 according to the invention firstly comprises a ring zone 12 and secondly skirt walls 14 which are connected by side walls 16 that carry the piston pin bosses 22. In the case shown, both side walls 16, i.e. also the side wall facing away from the viewer according to FIG. 1, are provided with two windows 18, 20, which are formed on both sides of the piston pin boss 22 in each case in the upper region of the side wall 16. The top of the windows 18, 20 is directly adjacent to the lower groove cheek of the lowermost annular groove, and the boundary thereof runs substantially in a plane perpendicular to the piston stroke axis. At the bottom, the boundaries of the windows 18, 20 run diagonally upward in the direction of the piston pin axis, and the lateral boundary on the side of the piston pin boss 22 runs (according to the depiction in FIG. 1) from the bottom to the top in an outwardly inclined manner. On the other side, i.e. the side of the skirt wall 14, the smaller window 18 has a boundary running substantially in the direction of the piston stroke axis, and all of the transitions between the boundaries described are rounded, in order to ensure stress optimization, and to reduce susceptibility to cracks.

Particularly on the right-hand side of FIG. 1, which could typically be the counter-pressure side, the window 20 shows the distinctive feature of the piston according to the invention. Here, the window 20 is clearly formed so as to be asymmetric to the window 18 and extends, in particular, into the region of the skirt wall 14.

Figure 2:
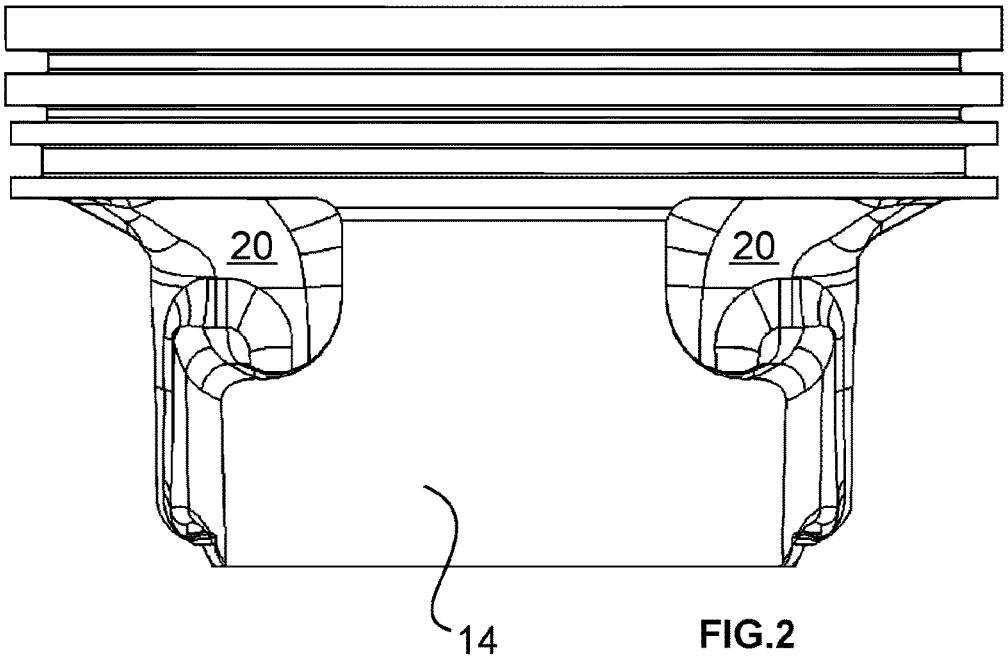
FIG. 2 is a side view of the piston in FIG. 1 from a direction perpendicular thereto.

As is revealed by FIG. 2 in particular, the skirt wall 14 is therefore cut concavely in this region, and the bearing region thereof is considerably reduced, particularly in the top half thereof. As a result, the effects described above can be achieved. In the viewing direction according to FIG. 2, i.e. perpendicular to the piston pin axis, the shape of the window can be described in the lower region thereof as being parallel to a plane perpendicular to the piston stroke axis, and further on as having a comparatively large curvature radius and parallel to the piston stroke axis at least in sections. All transitions are rounded, for the reasons given. In the lower region, the skirt wall 14 is designed with side edges parallel to the piston stroke axis. This preferably also applies to the other side wall, which is not cut in the embodiment example shown. The lower edges thereof are preferably parallel to a plane perpendicular to the piston stroke axis, and the lower edges of the side walls 16 are at least slightly concavely rounded, wherein in the example shown this concave rounding is more extensive on the pressure side, i.e. it is provided with a smaller curvature radius, than on the counter-pressure side. It should also be noted with respect to the piston according to the invention that it may comprise a combustion-chamber bowl and/or a cooling channel.

The invention claimed is:

1. A cast piston for an internal combustion engine, comprising a piston body having a longitudinal axis made of an iron-based material and having a plurality of piston lands separated by a plurality of piston ring grooves, and at least one skirt wall, and including windows in at least one side wall of the piston, the at least one side wall including a piston pin boss having an axis that is perpendicular to the longitudinal axis, and wherein the windows are asymmetric relative to one another and wherein at a bottom, the windows run diagonally upward in a direction of a piston pin axis, all transitions in the windows are rounded, lower edges of the side walls are at least concavely rounded, and the concave rounding has a smaller curvature radius on a pressure side than on a counter-pressure side of the piston body, and wherein the windows have flat top portions that lie in a common plane perpendicular to the longitudinal axis and in line with a bottom edge of a ring belt portion of the piston.

2. The piston according to claim 1, wherein the skirt wall is cut out in a concave manner when viewed perpendicular to the axis of the piston pin boss.

3. The piston according to claim 1 wherein a width of the skirt wall in the circumferential direction is reduced by at least 30% due to the windows.

4. The piston according to claim 1, wherein the windows are formed primarily in a half of the side wall that is closer to a piston crown.

5. The piston according to claim 1, wherein one of the windows has an extension of at least 40% of the height of the side wall in a direction of a piston stroke axis.

6. The piston according to claim 1, wherein the windows begin at an end of the side wall located in a direction of a piston crown.

7. The piston according to claim 1, wherein the piston is made from spheroidal graphite cast iron or cast steel.

8. The piston according to claim 1, wherein the material of the piston has a lower thermal conductivity than steel.

9. The piston according to claim 1, wherein the windows have flat bottom portions.

10. The piston according to claim 9, wherein the flat bottom portions are inclined away from each other.

11. The piston according to claim 9, wherein the flat bottom portions of the windows are non-parallel with respect to their respective flat top portions of the windows.

* * * * *